United States Patent [19]

Graham

[11] Patent Number: 4,982,451

[45] Date of Patent: Jan. 8, 1991

[54] HEAD COVERING DEVICE

[76] Inventor: Richard T. Graham, 15 Maple Grove Dr., Rochester, N.Y. 14428

[21] Appl. No.: 309,393

[22] Filed: Feb. 10, 1989

[51] Int. Cl.[5] ..... A42B 1/06

[52] U.S. Cl. ..... 2/410; 2/411; 2/201

[58] Field of Search ..... 2/171.1, 180, 201, 410, 2/411, 425, 2

[56] References Cited

U.S. PATENT DOCUMENTS

| | | | |
|---|---|---|---|
| 1,859,313 | 5/1932 | Pereles | 2/425 |
| 2,391,335 | 12/1945 | O'Brien | 2/425 |
| 2,969,547 | 1/1961 | Dye | 2/411 |
| 3,276,039 | 10/1966 | Lish | 2/201 X |
| 3,417,407 | 12/1968 | Divine | 2/180 |
| 3,820,780 | 6/1974 | Tarbox | 2/425 X |
| 4,062,067 | 12/1977 | Franzen | 2/410 |
| 4,571,959 | 2/1986 | Chesebro, Jr. et al. | 2/201 X |
| 4,646,367 | 3/1987 | El Hassen | 2/411 |
| 4,675,919 | 6/1987 | Heine et al. | 2/410 |
| 4,698,852 | 10/1987 | Romero | 2/411 X |

FOREIGN PATENT DOCUMENTS

| | | | |
|---|---|---|---|
| 0286726 | 10/1988 | European Pat. Off. | 2/411 |
| 3005001 | 8/1981 | Fed. Rep. of Germany | 2/425 |
| 1044265 | 9/1983 | U.S.S.R. | 2/410 |
| 429558 | 5/1934 | United Kingdom | 2/410 |

*Primary Examiner*—Werner H. Schroeder
*Assistant Examiner*—Sara M. Current
*Attorney, Agent, or Firm*—Howard J. Greenwald

[57] ABSTRACT

A head-covering device comprising a resilient, adjustable liner, a deformable fabric crown removably attached thereto, and plastic fasteners for removably attaching said deformable fabric crown to said liner, is disclosed. The liner is a single strip of flexible, resilient plastic which is a substantially U-shaped band and which is comprised of a spaced crown, a right arm and a left arm integrally joined to each other, an integrally-formed downwardly-extending cheek piece attached to each of the right and left arms, and a slot separating each of the arms. The liner has a uniform thickness of from about 0.032 to about 0.375 inches, and the internal side-to-side width of from about 4 to about 9 inches, and an internal end-to-end length of from about 6 to about 11 inches. The ratio of the internal length to the internal width of the liner is from about 1.1 to about 2.0. The width of said slot separating the right and left arms of the liner is from about 0.125 to about 1.5 inches. The deformable fabric crown consists essentially of fiber selected from the group consisting of man-made fiber, natural fiber, and mixtures thereof.

12 Claims, 3 Drawing Sheets

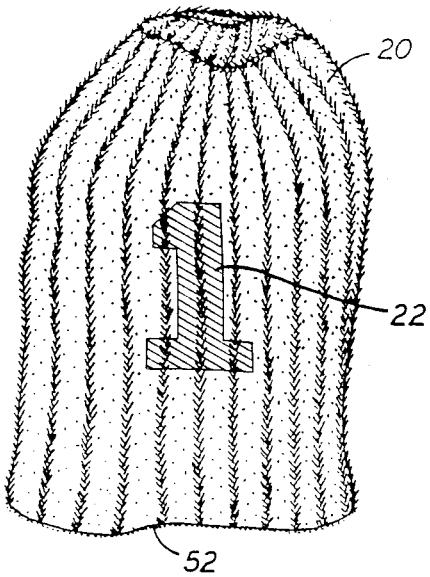
FIG. 5
FIG. 7
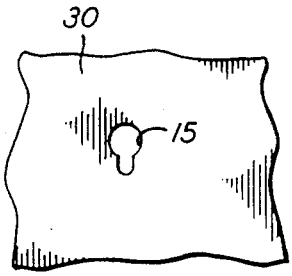
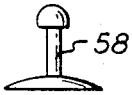
FIG. 6
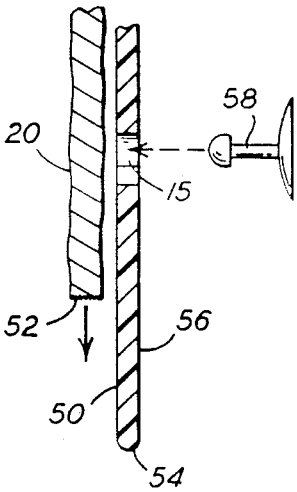
FIG. 8
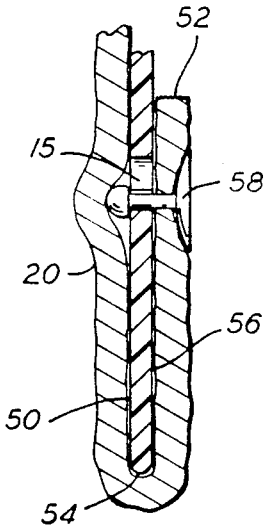
FIG. 9

HEAD COVERING DEVICE

FIELD OF THE INVENTION

A novel head covering device comprised of a one-piece, adjustable liner made of resilient plastic and a deformable fabric crown removably attached to the liner.

BACKGROUND OF THE INVENTION

Protective head coverings, especially those which are suitable for young children, are well known to those skilled in the art. Thus, e.g., U.S. Pat. No. 2,969,547 of Dye discloses such a head covering.

The Dye patent disclosed that "Young people, especially children, are prone to head injuries during ordinary forms of play and physical exercise. Conventional hats or caps afford little or no protection; and prior devices, which were adapted to be worn by children to protect their heads from injury, were difficult to put on, uncomfortable to wear, and interfered with their activities to such an extent that they were either entirely impractical, or the child refused to wear the devices while engaged in unsupervised play" (see column 1).

The device of the Dye patent was an improvement over prior art devices. However, it is unattractive, difficult to adjust, and relatively expensive to manufacture.

To the best of applicant's knowledge, the prior art does not provide a protective head covering device which is attractive, light weight, easy to adjust, provides protection from the elements to the head of the wearer, and it is relatively inexpensive. It is an object of this invention to provide such a device.

SUMMARY OF THE INVENTION

In accordance with this invention, there is provided a head-covering device comprising a resilient, adjustable, liner, a deformable fabric crown removably attached thereto, and means for removably attaching said deformable fabric crown to said liner.

The liner is a single strip of flexible, resilient plastic which is a substantially U-shaped band and which is comprised of a spaced crown, a right arm and a left arm integrally joined to each other, an integrally-formed downwardly-extending cheek piece attached to each of the right and left arms, and a slot separating each of the arms. The liner has a uniform thickness of from about 0.032 to about 0.375 inches, an the internal side-to-side width of from about 4 to about 9 inches, and an internal end-to-end length of from about 6 to about 11 inches. The ratio of the internal length to the internal width of the liner is from about 1.1 to about 2.0. The width of said slot separating the right and left arms of the liner is from about 0.125 to about 1.5 inches.

The deformable fabric crown consists essentially of fiber selected from the group consisting of man-made fiber, natural fiber, and mixtures thereof.

DESCRIPTION OF THE DRAWINGS

The present invention will be more fully understood by reference to the following detailed description thereof, when read in conjunction with the attached drawings, wherein like reference numerals refer to like elements and wherein:

FIG. 5 is a perspective view of one deformble fabric crown used in applicant's device;

FIG. 6 is a perspective view of one preferred nylon fastener used in applicant's device;

FIG. 7 is a partial side view of a a liner showing an orifice through which the fastener of FIG. 6 may be inserted; and FIGS. 8 and 9 illustrate how the fastener of FIG. 6 can be used to removably attach the fabric crown of FIG. 5 to the liner of FIG. 7.

DESCRIPTION OF THE PREFERRED EMBODIMENTS

The head covering device of this invention is comprised of a resilient, integral liner and, attached thereto, a deformable fabric crown.

Figure 1:
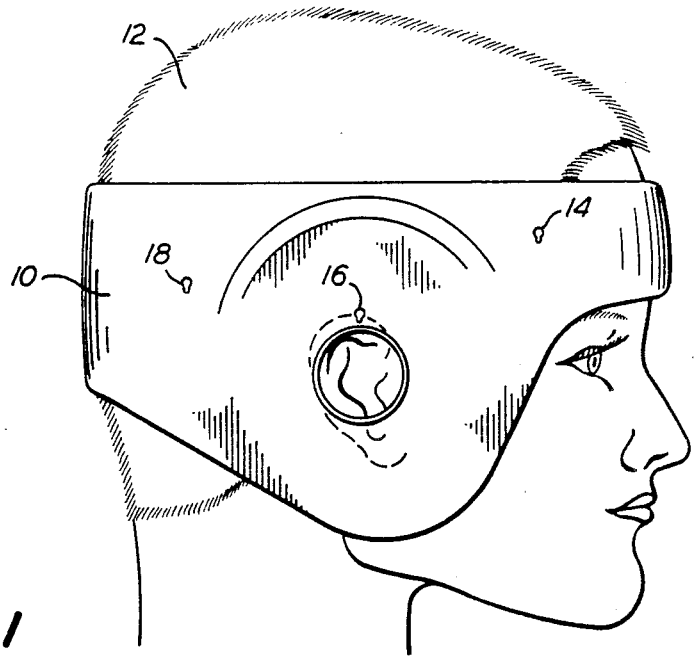
FIG. 1 is a side view of a preferred embodiment of the liner used in applicant's invention in place on a wearer's head.

Referring to FIG. 1, one embodiment of a liner 10 which may be used in this invention is shown 10 on the head 12 of a wearer. Although applicant's invention does not consist solely of liner 10, liner 10 is shown without the deformable fabric crown attached to it in FIG. 1 in order to illustrate how such liner fits around the wearer's head.

As is illustrated in FIG. 1, liner 10 preferably comprises at least three orifices on each of its sides. Thus, for example, orifices 14, 16, and 18 are shown on the side of the liner 10 depicted in Figure; comparable orfices 15, 17, and 19 (not shown in FIG. 1 but shown in FIG. 3) appear in the other side of the liner 10. These orifices provide one preferred means for securing the deformable fabric to the liner 10; other such means known to those skilled in the art also can be used.

Figure 2:
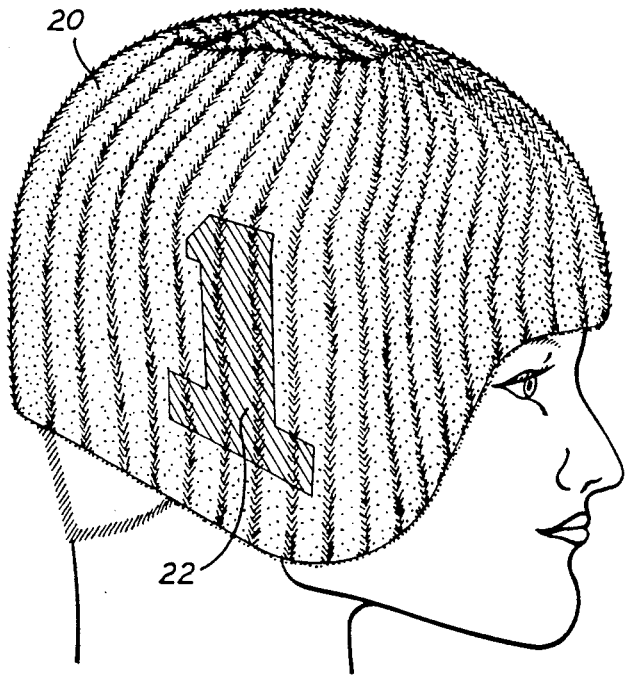
FIG. 2 is a side view of a preferred embodiment of applicant's protective head covering in place on a wearer's head.

FIG. 2 illustrates the head covering device of this invention in use on a wearer's head. Referring to FIG. 2, it will be seen that applicant's head covering device is comprised of a deformable fabric crown 20 which is secured to liner 10 (not shown in FIG. 2). Fabric crown 20 is deformable, i.e., when the top of it is in contact with the top of the wearer's head, it tends to conform its shape to the shape of the wearer's head. Fabric crown 20 may contain one or more insignia such as, e.g., insignia 22. It may contain one or more different colors.

The deformable fabric crown 20 preferably consists essentially of yarn. As used in this specification, the term yarn refers to a continuous strand of twisted threads of natural and/or synthetic material, such as wool, cotton, flax, nylon, etc., which is often used in weaving or knitting. Processes for the formation of yarn, and its use in textiles, are well known to those skilled in the art. Thus, for example, such processes are described on pages 547–560 of Volume 13 of the "McGraw-Hill Encylopedia of Science & Technology" (McGraw-Hill Book Company, N. Y., 1977), the disclosure of which is hereby incorporated by reference into this specification.

Either a man-made fiber and/or a natural fiber may be used in the deformable fabric crown 20. The preparation of these fibers is described, e.g., on pages 263–277 of Volume 5 of the "McGraw-Hill Encylopedia of Science & Technology," supra, the disclosure of which is hereby incorporated by reference into this specification.

Suitable natural fibers which may be used in fabric crown 20 include, e.g., wool, flax, cotton, silk and the like. Suitable natural fabrics include cottons (such as gingham, madras, seersucker, gabardine, chintz, corduroy, and velvet), wools (such as light tweeds, flannel, gabardine, crepe, and velour), silks (such as Thai, Indian, and oriental silks, twill, tweed and raw silk, foulard, crepe, brocade, velvet, and satin), linens, pile fabrics (such as velvets and fur piles), leathers, suedes, furs, and the like.

Suitable man-made fibers which may be used in deformable fabric crown 20 include, e.g., regenerated cellulose, cellulose diacetate, cellulose triacetate, polyuamide, polyester, polyacrylic, polyvinyl, polyolefin, and the like.

In one preferred embodiment, only one fiber is used in the fabric crown 20. Thus, in one preferred embodiment, acrylic fiber is used in deformable fabric crown 20. As used in this specification, the term acrylic fiber is a manufactured fiber in which the fiber-forming substance is any long-chain synthetic polymer composed of at least 85 percent by weight of acrylonitrile units of the formala —$CH_2CH(CN)$—. Acrylic fiber usually has a tensile strength of from about 2 to about 3 grams per denier, a water absorption of from about 1.5 to about 2.5 percent, and a density of about 1.17. Suitable acrylic fibers include "ACRILAN" (Monsanto Corporation), "CRESLAN" (American Cyanamide Corporation), "ORLON" (DuPont Corporation), and the like.

In one embodiment, the fiber used in the deformable fabric crown 20 is modacrylic fiber. As used in this specification, the term modacrylic fiber refers to a manufactured fiber in which the fiber-forming substance is any long chain synthetic polymer composed of less than 85% but at least 35% of acryonitrile units.

Mixtures of natural fiber(s) and man-made fiber(s) may be used in the deformable fabric crown 20. Thus, by way of illustration, one may use two or more man-made fibers, two or more natural fibers, one or more natural fibers together with one or more man-made fibers, and the like.

The fiber(s) may be made into fabric by the techniques described on pages 547–560 of Volume 13 of the "McGraw-Hill Enclopedia of Science & Technology," supra; suitable fabrication techniques include, e.g., weaving and kniting. The fabric(s) may be made into deformable fabric crown 20 by means well known to those skilled in the art. Thus, e.g., one may use the hat-making techniques described in Alan Couldridge's "The Hat Book," (Prentice Hall, Inc., Englewood Cliffs, N. J., 1980) and Rosalind Weiss' "How to Make Hats" (McGraw-Hill Book Company, N.Y., 1931), the disclosure of each of which is hereby incorported by reference into this specification.

It is preferred that deformable fabric crown 20 consist essentially of a knit fabric. It is even more preferred that such knit fabric be a knit acrylic fabric. It is even more preferred that the knit acrylic fabric be a four-layer knit fabric. In the most preferred embodiment, knit acrylic fabric crown 20 has a weight of less than about 8.0 ounces.

In the construction of the head-covering device of this invention, deformable fabric crown 20 is pulled over liner 10 and thereafter attached to this liner. The deformable fabric crown 20 tends to compress the arms of liner and thus helps to insure a tight fit on the wearer's head. However, liner 10 is resilient, and it also tends to insure a tight fit on the wearer's head.

Figure 3:
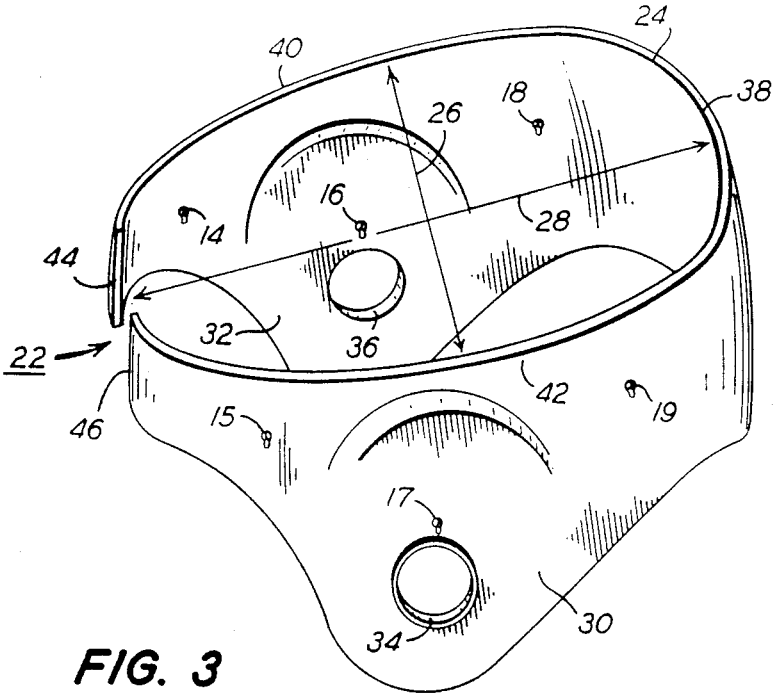
FIG. 3 is a perspective view of one embodiment of the liner used in applicant's protective head covering.

Referring to FIG. 3, a side view of one embodiment of integral, adjustable liner 10 is shown. As illustrated in FIG. 3, one-piece adjustable liner 10 liner may be made from a single strip of a flexible, resilient plastic. The strip, which may be from about 0.063 to about 0.375 inches thick, may be stamped out with a die or cut with a band saw.

In one embodiment, integral, adjustable liner 10 is made by cutting off the top of a helmet purchased from the Hutch Sporting Goods Inc., 1948 West 8th Street, Cincinnati, Ohio. The liner thus produced by cutting off the top of the helmet has a "spaced crown," i.e., there is a hole in the top of it. Thus, by way of illustration, one may purchase the Hutch helmet in the outfit described as stock number 601; this helmet is a team replica helmet made of a one-piece molded polyethylene shell with foam padding. Thus, e.g., one may purchase the Hutch helmet in the outfits described as stocknumbers 605, 60692, and 60693. Liner 10 is similar to a normal football helmet with the crown removed, with one difference—a slot 22 is cut in the front of the helmet to insure that liner 22 is adjustable. The football helmet from which the liner is produced may be cut so that liner 10 has certain specified dimensions.

Rim 24 of liner 10 appears where the football helmet is cut. This rim 24, and the liner 10, preferably have a maximum internal side to side width 26 of from about 4 to about 9 inches and, more preferably, from about 5 to about 7 inches. In the most preferred embodiment, the side to side width 26 of the liner 10 is about 6 inches.

The end to end internal length 28 of the liner 10 is from about 6 to about 11 inches and, preferably, from about 7 to about 10 inches. In the most preferred embodiment, the end to end internal length 28 of the liner 10 is about 9 inches.

Liner 10 has a substantially oval shape, and thus the ratio of length 28 to width 26 is from about 1.1 to about 2.0. It is preferred that the ratio of length 28 to width 26 be from about 1.3 to about 1.7. In the most preferred embodiment, such ratio is from about 1.4 to about 1.6.

Liner 10 has preferably has a uniform thickness of from about 0.0313 to about 0.375 inches. The preferred width of liner 10 is about 0.125 inches.

In the preferred embodiment illustrated in the Figures, liner 10 is a single strip of flexible resilient plastic which comprises a head band portion having two integrally formed, downwardly-extending cheek 30 and 32. These cheek pieces 30 and 32 are adapted to extend downward in front of each ear to protect the ear cartilage and the temple portions of the head. In the preferred embodiment illustrated in FIGS. 3 and 4, cheek pieces 30 and 32 are comprised of orifices 34 and 36, respectively. These orifices facilitate the transmission of sound through to the wearer's ears.

Once slot 22 is cut into the liner, the liner 10 is preferably substantially horseshoe shaped. Thus, for example, liner 10 is comprised of left arm 40, top 38, and right arm 42, all joined to form one substantially U-shaped piece; although the shape illustrated in the Figures does not describe a perfect U-shape, it is to be understood that the term U-shaped as used in this specification includes the shape depicted in the Figures. Left arm 40 and right arm 42 are separated by slot 22. Slot 22 is cut in the front portion of liner 10 to insure that it is adjustable. A sufficiently large slot is cut so that the distance between the front edge 44 of left arm 40 and the front edge 46 of right arm 42 will be from about 0.125 to about 1.5 inches. It is preferred that the distance between front edge 44 and front edge 46 is from about 0.25 to about 1.0 inches. It is also preferred that slot 22 be cut so that front edge 44 and front edge 46 are both substantially straight and both substantially parallel to each other. In one preferred embodiment, not shown, the ends of front edges 44 and 46 are slightly rounded to minimize the chance of the wearer injuring himself.

The materials in liner 10, and its dimensions, are so chosen that liner 10 is resilient. A resilient material is one which, after it has been bent, stretched, or compressed, resumes its original shape. As used in this specification with reference to a liner, the term resilient refers to a liner which, after front edges 44 and 46 have had sufficient external force applied to them to separate them 6.0 inches, and after the force is then removed, these edges will return to substantially their original position so that the distance between them will be from about 0.125 to about 1.5 inches. This property of resiliency allows a wearer to adjust liner 10 so that it can snugly fit around his head.

It is preferred to use a suitable resilient material in liner 10. Thus, by way of illustration and not limitation, one may use polyethylene, polystyrene, natural rubber, synthetic rubber, felt, resilient plastic, and the like. materials which will work).

The headcovering device of this invention comprises means for attaching liner 10 to deformable fabric crown 20. In one embodiment, not shown, means are provided for permanently attaching fabric crown 20 to liner 10; such attachment may be effectuated by, e.g., fastening the fabric crown to the liner with glue. In another embodiment, illustrated in FIGS. 6–9, means are provided for removably attaching fabric crown 20 to liner 10. This latter embodiment is preferred inasmuch as it allows one to remove the fabric crown 20 from the liner, wash it, and then reattach it to the liner.

Conventional means for removably attaching fabric crown 20 to liner 10 may be used. Thus, e.g., such removable attachment may be made by means of "VELCRO" material, by embedded snaps, by buckles, by tie strings, and the like. Thus, e.g., one may utilize the means illustrated in FIGS. 6–10.

In the means illustrated in FIGS. 5–9, liner 10 is comprised of at least 6 orifices, 3 of which appear on each of its arms 40 and 42. In this embodiment, for each of arms 40 and 42, at least one orifice (such as orifices 14 and 15) must appear in the first one-third of length 28 of the arm, at least one orifice (such as orifices 16 and 17) must appear in the second one-third of the length 28 of the arm, and at least one orifice (such as orifices 18 and 19) must appear in the last one-third of the length of the arms. The orifices preferably are so configured as to receive and secure a fastener pushed through fabric crown 20 into the orifice.

Figure 4:
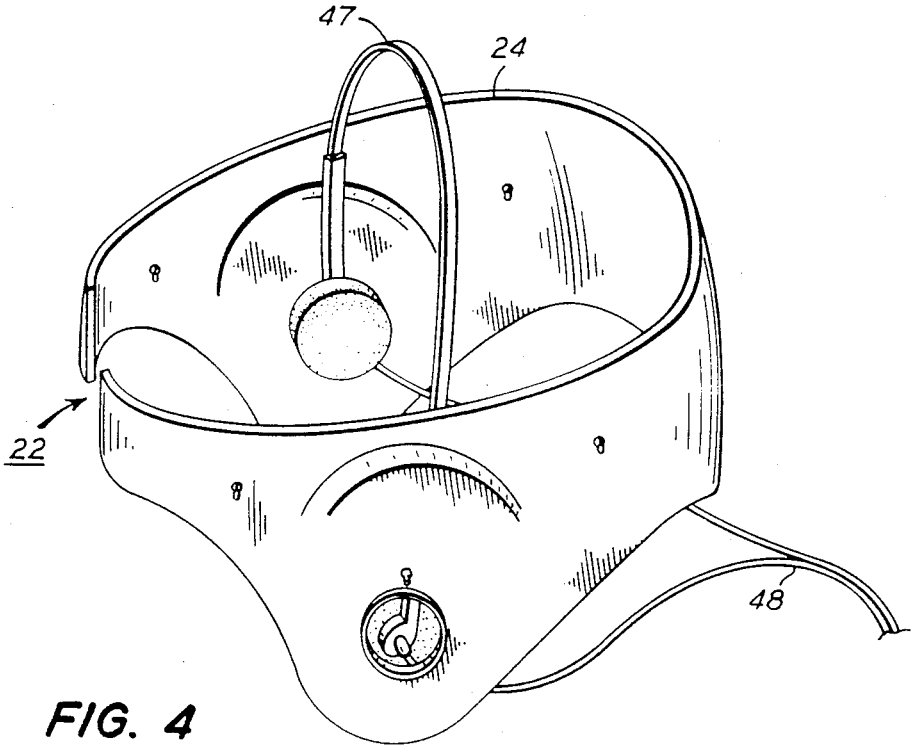
FIG. 4 is a perspective view of another embodiment of the liner used in applicant's protective head covering.

FIG. 4 illustrates a preferred embodiment of the invention in which liner 10 is provided with earphones 47 whose output communicates with the wearer's ears. Earphones 47 may be connected via wires 48 to the output (not shown) of a radio (not shown) and/or tape player (not shown) and/or a compact disc player (not shown).

FIGS. 5 through 9 illustrate one preferred means of removably attaching crown 20 to liner 10. In this preferred embodiment, deformable fabric crown 20, which preferably is in the shape of a stocking cap, is pulled down over the outside surface 50 of liner 10; the bottom edge 52 is pulled down over surface 50, around the lower edge 54 of liner 10, and up around in contact with the inner surface 56 of liner 10; in this position it is secured to liner 10 with fastener 58.

Any suitable fastener may be used to removably secure fabric crown 20 to liner 10. Thus, e.g., one may use the fasteners described on pages 197–226 of Robert H.1 Creamer's "Machine Design," Third Edition (Addison-Wesley Publishing Company, Reading, Mass., 1984), the disclosure of which is hereby incorporated by reference into this specification.

It is preferred to use plastic fasteners, which can readily be unfastened, to removably secure fabric crown 20 to liner 10. Thus, e.g., one may use nylon fasteners produced by the Micro Plastics Inc. of Flippin, Ark.; push-in fasteners with a 0.062 to a 0.780 grip may, e.g., be used. Thus, e.g., one may used plastic fasteners manufactured by the Magic Mold Corporation of Southampton, Pa.

One suitable fastener which may be used is fastener 58, illustrated in FIG. 6. Fastener 58 is adapted to be received by and secured by orifice 15 (see FIG. 6). Fastener 58 may be pushed through crown fabric 20 (see FIG. 8) and orifice 15, thereby securing crown fabric 20 to liner 10(see FIG. 9).

It is to be understood that the aforementioned description is illustrative only and that changes can be made in the apparatus, in the ingredients and their proportions, and in the sequence of combinations and process steps as well as in other aspects of the invention without departing from the scope of the claimed invention.

I claim:

1. A head-covering device comprising a resilient, adjustable liner, a deformable fabric crown removably attached thereto, and means for removably attaching said deformable fabric crown to said liner, wherein:

(a) said liner is comprised of an outside surface and an inside surface and is a single strip of flexible, resilient plastic which is substantially U-shaped and which is comprised of a spaced crown, a right arm and a left arm integrally joined to each other, an integrally-formed downwardly-extending cheek piece attached to each of said right and left arms, and a slot separating each of said right and left arms, wherein:

1. said liner has a uniform thickness of from about 0.032 to about 0.375 inches,
2. the internal side-to-side width of said liner is from about 4 to about 9 inches, the internal end-to-end length of said liner is from about 6 to about 11 inches, and the ratio of the internal length to the internal width of the liner is from about 1.1 to about 2.0, and
3. the width of said slot separating said right and said left arm of said liner is from about 0.125 to about 1.5 inches; and (b) said deformable fabric crown consists essentially of a knit fabric which fabric consists essentially of acrylic fiber; and (c) said deformable fabric crown is contiguous with both said outside surface and said inside surface of said liner and completely covers said outside surface and said inside surface.

2. The head covering device as recited in claim 1, wherein said flexible, resilient plastic is selected from the group consisting of polyethylene and polystyrene.

3. The head covering device as recited in claim 2, wherein said flexible, resilient plastic is polyethylene.

4. The head covering device as recited in claim 2, wherein said internal side-to-side width of said liner is from about 5 to about 7 inches.

5. The head covering device as recited in claim 4, wherein said internal end-to-end length of said liner is from about 7 to about 10 inches.

6. The head covering device as recited in claim 5, wherein the ratio of said internal length to said internal width of said liner is from about 1.3 to about 1.7.

7. The head covering device as recited in claim 6, wherein each of said integrally-formed downwardly-extending check pieces comprises an orifice.

8. The head covering device as recited in claim 7, wherein the width of said slot separating said right arm and said left arm of said liner is from about 0.25 to about 1.0 inches.

9. The head covering device as recited in claim 8, wherein said liner comprises at least six orifices.

10. The head covering device as recited in claim 9, wherein said internal side-to-side width of said liner is about 6 inches.

11. The head covering device as recited in claim 10, wherein said internal end-to-end length of said liner is about 9 inches.

12. The head covering device as recited in claim 11, wherein said means for removably attaching said deformable fabric crown to said liner is comprised of plastic fasteners.

* * * * *